US006846212B2

(12) United States Patent
Wada et al.

(10) Patent No.: US 6,846,212 B2
(45) Date of Patent: Jan. 25, 2005

(54) FUEL SUPPLY SYSTEM FOR ENGINE

(75) Inventors: Tetsu Wada, Saitama (JP); Tomonori Ikuma, Saitama (JP); Sadafumi Shidara, Saitama (JP); Makoto Sakai, Kanagawa (JP); Kazuki Ishikawa, Miyagi (JP); Nobuhiro Takahashi, Miyagi (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/143,819

(22) Filed: May 14, 2002

(65) Prior Publication Data

US 2003/0008572 A1 Jan. 9, 2003

(30) Foreign Application Priority Data

May 15, 2001 (JP) ..... 2001-145398

(51) Int. Cl.[7] ..... F02M 37/20
(52) U.S. Cl. ..... 440/88 F; 123/516
(58) Field of Search ..... 440/88 R, 88 F, 440/88; 123/495, 506, 510, 516, 518, 519, 520, 457, 459, 461

(56) References Cited

U.S. PATENT DOCUMENTS 4,856,483 A * 8/1989 Beavis et al. ..... 123/516
5,865,160 A 2/1999 Kato
5,913,294 A 6/1999 Takahashi et al.
6,032,654 A * 3/2000 Kato ..... 123/509
6,257,208 B1 * 7/2001 Harvey ..... 123/516
6,322,410 B1 * 11/2001 Harvey ..... 440/88 R
6,431,199 B1 * 8/2002 Kolb et al. ..... 137/202
6,453,877 B1 * 9/2002 Lucier et al. ..... 123/497

FOREIGN PATENT DOCUMENTS

JP 11-82207 3/1999

OTHER PUBLICATIONS

Patent Abstracts of Japan, vol. 2000, No. 7, Sep. 29, 2000 & JP 2000 110686, Apr. 18, 2000.

* cited by examiner

*Primary Examiner*—Andrew Wright
(74) *Attorney, Agent, or Firm*—Arent Fox PLLC

(57) ABSTRACT

In fuel supply system for an engine in which a discharge port in a fuel pump driven by the engine to draw up fuel in a fuel tank is connected to an inlet port which is provided in a fuel reservoir and which is controlled in opening and closing by a float valve so that the fuel in the fuel reservoir is supplied to the engine, a second discharge port is provided in the fuel pump, and a second inlet port without a float valve is provided in the fuel reservoir. The second discharge port and the second inlet port are connected to each other through a control valve opened during starting of the engine. Thus, when the engine is started, fuel vapor generated in a pump chamber in the fuel pump can be discharged to the fuel reservoir having an air vent, to normalize the function of the fuel pump, leading to an enhancement in hot startability of the engine.

9 Claims, 4 Drawing Sheets

FUEL SUPPLY SYSTEM FOR ENGINE

BACKGROUND OF THE INVENTION

1. Field of the Invention

The present invention relates to an improvement in a fuel supply system for an engine, in which a discharge port in a pump chamber in a fuel pump driven by the engine to draw up fuel in a fuel tank is connected to an inlet port which is provided in a fuel reservoir having an air vent and which is controlled in opening and closing by a float valve so that the fuel in the fuel reservoir is supplied to the engine.

2. Description of the Related Art

There is a conventional fuel supply system for an engine, in which a normally-closed one-way valve is incorporated in a fuel passage extending between a fuel tank and a fuel pump for drawing up fuel in the tank for permitting a flow of fuel only in one direction from the fuel tank to the fuel pump so that the fuel in a pump chamber in the fuel pump is prevented by the one-way valve from flowing back to the fuel tank during stoppage of the operation of the engine, thereby enhancing the hot startability of the engine (see Japanese Patent Application Laid-open No. 11-82207).

In the conventional system, however, when the engine itself and the its atmosphere are at a high temperature during stoppage of the operation of the engine, fuel vapor is generated in the pump chamber in the fuel pump and impedes the pumping function of the fuel pump at the hot start of the engine in some cases, resulting in a detracted startability.

SUMMARY OF THE INVENTION

Accordingly, it is an object of the present invention to provide a fuel supply system for an engine, wherein when the engine is started, fuel vapor generated in the pump chamber in the fuel pump is discharged to a fuel reservoir, whereby the fuel pump is normally functioned immediately to contribute to an enhancement in hot startability of the engine.

To achieve the above object, according to a first aspect and feature of the present invention, there is provided a fuel supply system for an engine, in which a discharge port in a pump chamber in a fuel pump driven by the engine to draw up fuel in a fuel tank is connected to an inlet port which is provided in a fuel reservoir having an air vent and which is controlled in opening and closing by a float valve so that the fuel in the fuel reservoir is supplied to the engine, wherein a second discharge port is provided in the pump chamber, and a second inlet port having no float valve is provided in the fuel reservoir, the second discharge port and the second inlet port being connected to each other through a control valve for controlling the communication between the second discharged port and the second inlet port.

With such arrangement of the first feature, the fuel vapor generated in the pump chamber in the fuel pump can be discharged to the fuel reservoir and further to an air vent by properly operating the control valve to permit the second discharge port in the fuel pump and the second inlet port in the fuel reservoir to communicate with each other, thereby ensuring the normal function of the fuel pump and providing an enhancement in hot startability of the engine.

According to a second aspect and feature of the present invention, in addition to the arrangement of the first feature, the control valve is a solenoid valve which is opened and closed depending on the operational state of the engine.

With such arrangement of the second feature, the controlling of the control valve can be carried out appropriately depending on the operational state of the engine, and the discharging of the fuel vapor from the pump chamber in the fuel pump can be carried out simply and reliably.

According to a third aspect and feature of the present invention, in addition to the arrangement of the first or second feature, the control valve is opened during starting of the engine.

With such arrangement of the third feature, the pump chamber in the fuel pump can be opened to the fuel reservoir during starting of the engine, thereby discharging the fuel vapor generated in the pump chamber to the fuel reservoir, leading to an enhancement in hot startability of the engine.

According to a fourth aspect and feature of the present invention, in addition to the arrangement of the third feature, the opening of the control valve is continued until a given time is lapsed after starting of the engine.

With such arrangement of the fourth feature, the fuel vapor in the pump chamber of the fuel pump can be prevented reliably from remaining therein by ensuring that the control valve opened at the start of the engine is kept opened for a given time even after starting of the engine.

According to a fifth aspect and feature of the present invention, in addition to the arrangement of the fourth feature, when the engine or its atmosphere is in a high-temperature state within the given time, the opening of the control valve is continued.

With such arrangement of the fifth feature, when the engine or the engine room is in the high-temperature state, the opening of the control valve opened at the start of the engine can be continued within the given time even after the starting of the engine, whereby the useless opening of the solenoid valve can be prevented when the engine or the engine room is in a low-temperature state in which there is a less possibility of generation of fuel vapor.

According to a sixth aspect and feature of the present invention, in addition to the arrangement of the fourth feature, when the engine is under a high load within the given time, the opening of the control valve is continued.

With such arrangement of the sixth feature, when the engine is in a high load state, the opening of the control valve opened at the start of the engine can be continued within the given time even after starting of engine, whereby the refueling to the fuel reservoir corresponding to the high load state can be carried out.

According to a seventh aspect and feature of the present invention, in addition to the arrangement of the fourth feature, when the engine is in a high-speed rotation state within the given time, the opening of the control valve is continued.

With such arrangement of the seventh feature, when the engine is in the high load state, the opening of the control valve opened at the start of the engine can be continued within the given time even after starting of engine, whereby the refueling to the fuel reservoir corresponding to the highly rotated state can be carried out.

According to an eighth aspect and feature of the present invention, in addition to the arrangement of any of the first to seventh features, the second discharge port is disposed in an upper portion of the pump chamber in the fuel pump.

With such arrangement of the eighth feature, when the control valve is opened, fuel vapor can be discharged more smoothly from the pump chamber in the fuel pump.

According to a ninth aspect and feature of the present invention, in addition to the arrangement of any of the first to eighth features, the fuel pump and the fuel reservoir are disposed in an engine room in an outboard engine system, and a fuel pipe leading to an intake port in the fuel pump is connected through a joint to a fuel outlet pipe leading to an outlet of the fuel tank mounted on a hull, so that fuel in the fuel reservoir is supplied to fuel injection valves in the engine within the engine room by a secondary fuel pump.

With such arrangement of the ninth feature, even in the narrow and difficultly heat-dissipatable engine room in the outboard engine system, fuel vapor generated in the pump chamber in the primary fuel pump can be discharged promptly to the fuel reservoir at starting of the engine, thereby enhancing the hot startability of the engine.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

In the description made below, the terms "front", "rear", "left" and "right" are referred to with respect to a hull H to which an outboard engine system O is mounted.

Figure 1:
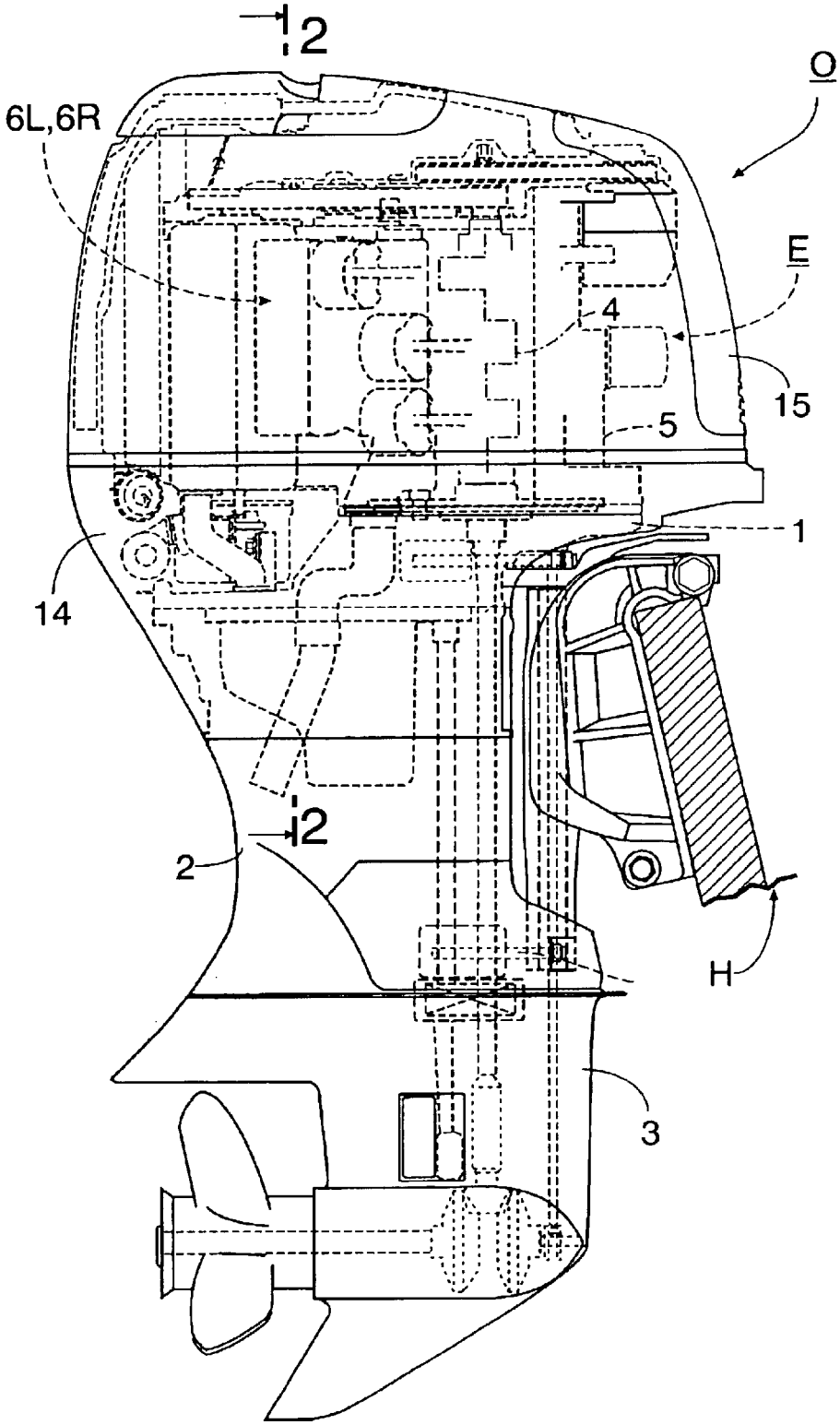
FIG. 1 is a side view of the entire arrangement of an outboard engine system according to an embodiment of the present invention.
Figure 2:
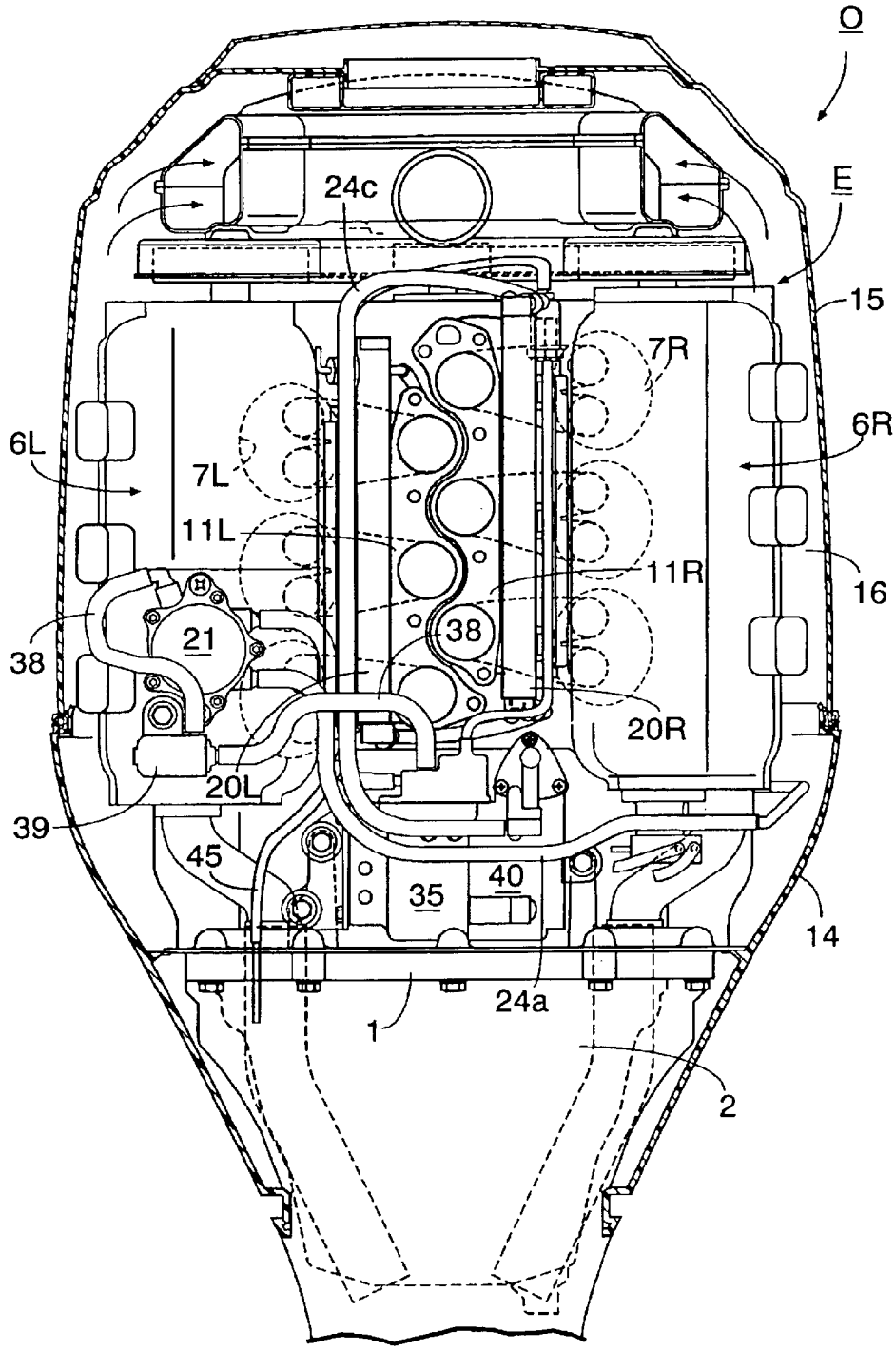
FIG. 2 is a sectional view taken along a line 2—2 in FIG. 1.

Referring to FIGS. 1 and 2, the outboard engine system O mounted at a rear end of the hull H includes a mount case 1, an extension case 2 coupled to a lower end face of the mount case 1, and a gear case 3 coupled to a lower end face of the extension case 2. A V-type 6-cylinder and water-cooling 4-stroke engine E is mounted on an upper end face of the mount case 1 with a crankshaft 4 disposed vertically.

An annular undercover 14 is secured to the mount case 1. The undercover 14 covers the periphery of a section extending from a lower portion of the engine E to an upper portion of the extension case 2, and an engine hood 15 is detachably mounted at an upper end of the undercover 14 to cover the engine E from above. An engine room 15 for accommodation of the engine E is defined by the engine hood 15 and the undercover 14.

The engine E includes a crankcase 5 for supporting the vertically disposed crankshaft 4, and a pair of left and right banks 6L and 6R spreading into a V-shape in a rearward direction from the crankshaft 4. A lower surface of the crankcase 5 is bolted to a mounting surface of an upper portion of the mount case 1.

Each of the banks 6L and 6R includes a plurality of (three in the illustrated embodiment) cylinder bores 7L, 7R arranged vertically.

Figure 3:
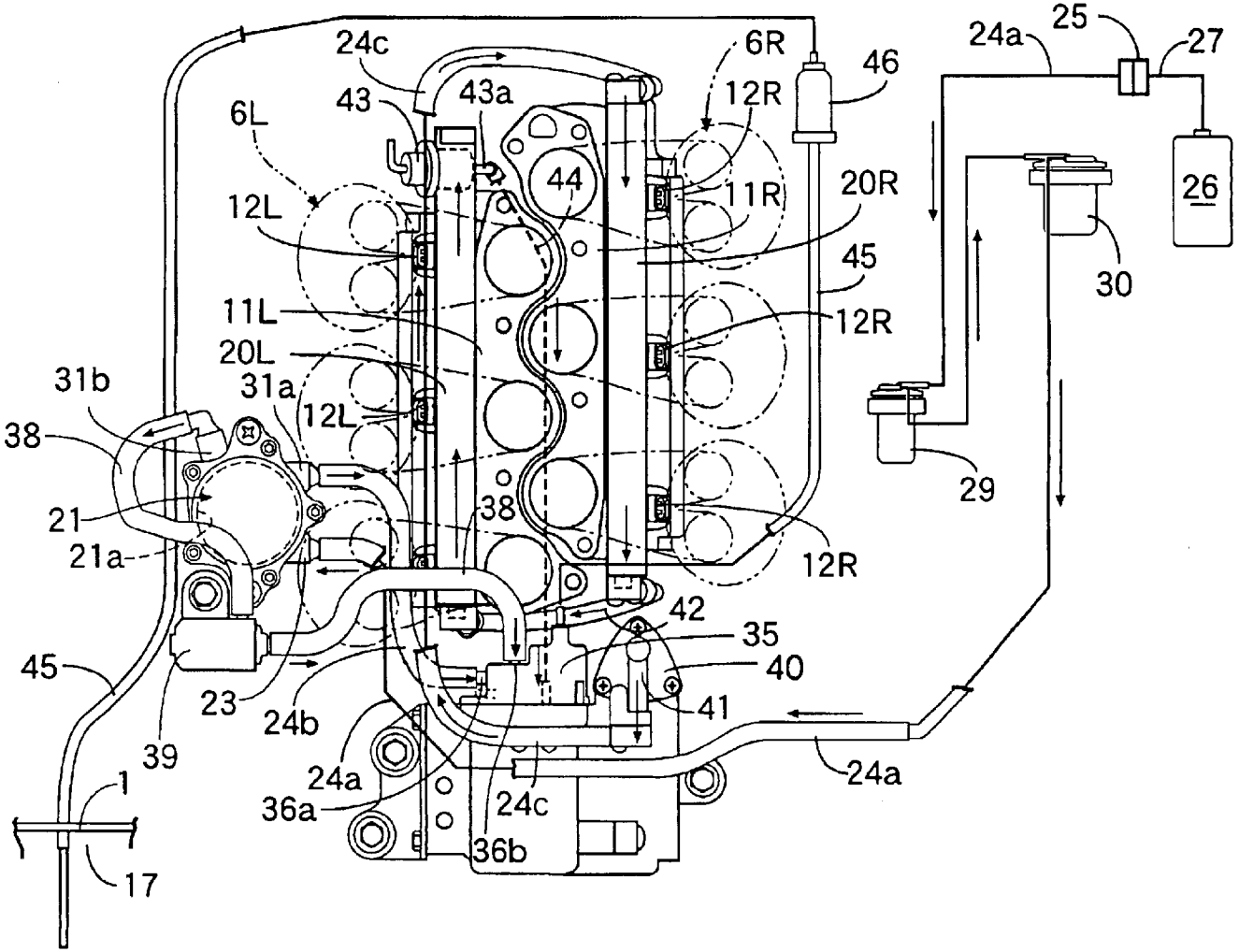
FIG. 3 is a diagram of the entire fuel supply system for an engine in the outboard engine system.

As shown in FIG. 3, mounted to intake pipes 11L and 11R of the left and right banks 6L and 6R are electromagnetic fuel injection valves 12L and 12R for injecting fuel toward downstream portions of the intake pipes 11L ands 11R, and left and right fuel rails 20L and 20R for dispensing fuel to the fuel injection valves 12L and 12R.

A diaphragm-type primary fuel pump 21 is disposed at a head of one 6L or 6R of the banks and mechanically driven by a valve-operating camshaft in the bank 6L or 6R. A first fuel pipe 24*a* connected to an intake port 23 in a pump chamber 21*a* in the primary fuel pump 21 is connected to a fuel outlet pipe 27 extending from a fuel tank 26 disposed on the hull H. An intake valve 28 is mounted in the intake port 23.

A first fuel filter 29 and a second fuel filter 30 are incorporated in the named order from the upstream side in the middle of the first fuel pipe 24*a*. The first fuel filter 29 is adapted to remove water from the fuel, and the second fuel filter 30 is adapted to remove other foreign matters from the fuel.

Figure 4:
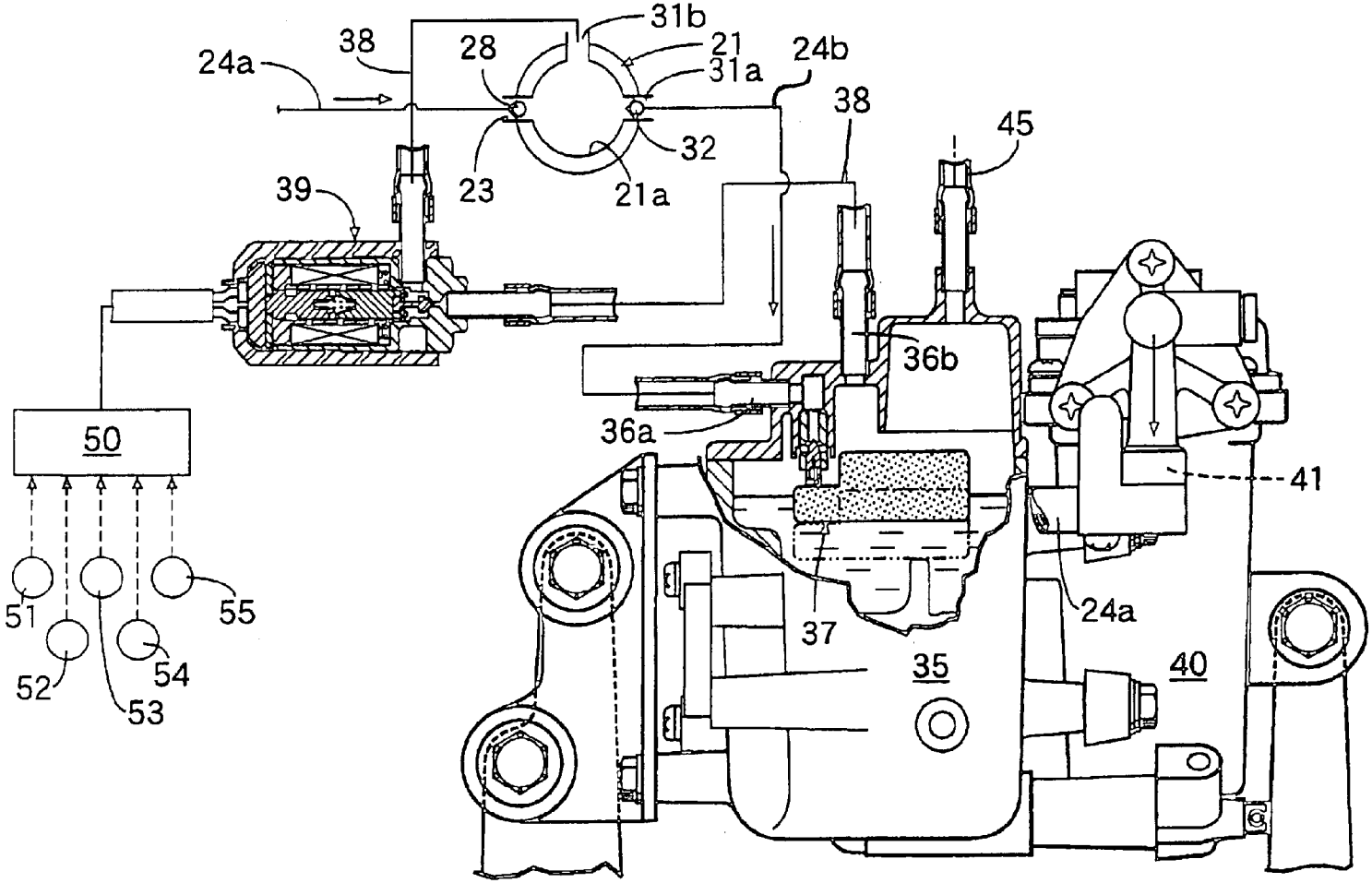
FIG. 4 is a partially vertical sectional enlarged view of essential portions of FIG. 3.

As clearly shown in FIG. 4, first and second discharge ports 31*a* and 31*b* are provided in parallel in the pump chamber 21*a* of the primary fuel pump 21. A discharge valve 32 is mounted in the first discharge port 31*a*, as in a normal discharge port, but no discharge valve is mounted in the second discharge port 31*b*. The first discharge port 31*a* is disposed in a lower portion or a vertically intermediate portion of the pump chamber 21*a* to improve the discharge of the fuel from the pump chamber 21*a*, and the second discharge port 31*b* is disposed in an upper portion of the pump chamber 21*a* to promote the discharge of fuel vapor generated in the pump chamber 21*a*.

The first discharge port 31*a* is connected through a second fuel pipe 24*b* to a first inlet port 36*a* provided in a ceiling wall of a fuel reservoir 35 placed on the mount case 1. A known float valve 37 is mounted in the fuel reservoir 35 and adapted to close the first inlet port 36*a* when the level of the stored fuel oil becomes equal to or higher than a predetermined level. Therefore, during operation of the engine E, a given amount of fuel drawn up from the fuel tank 26 by the primary fuel pump 21 is stored in the fuel reservoir 35. A pivot axis (not shown) of a float of the float valve 37 is disposed in parallel to a tilting shaft of the outboard engine system O in order to appropriately operate the float valve 37 even during tilting of the outboard engine system O.

A second inlet port 36*b* without a float valve is provided in the ceiling wall of the fuel reservoir 35 and normally communicates with the fuel reservoir, and the second discharge port 31*b* in the primary fuel pump 21 is connected to the second inlet port 36*b* through a fuel vapor discharge pipe 38. A normally-closed solenoid valve 39 is incorporated in the fuel vapor discharge pipe 38.

A electrically-operated secondary fuel pump 40 is connected to one side of the fuel reservoir 35 for drawing up the fuel stored in the fuel reservoir 35, and has a discharge port 41 connected to an upper end of the right fuel rail 20R through a third fuel pipe 24*c*. Therefore, high-pressure fuel discharged from the secondary fuel pump 40 fills the right fuel rail 20R from its upper end, and is then passed through a communication pipe 42 to fill the left fuel rail 20L from its lower end and supplied to the fuel injection valves 12L and 12R.

A pressure regulator 43 is mounted at an upper end of the left fuel rail 20L. The pressure regulator 43 is adapted to regulate the pressures in both of the fuel rails 20L and 20R, i.e., regulate the pressures of fuel injected from the fuel injection valves 12L and 12R. A fuel return pipe 44 is connected to a surplus fuel outlet pipe 43*a* of the pressure regulator 43 and opens at its terminal end into the fuel reservoir 35. Therefore, the surplus fuel resulting from the pressure regulation by the fuel pressure regulator 43 is returned to the fuel reservoir 35 through the fuel return pipe 44. The fuel pressure regulator 43 is adapted to control the pressure of fuel injected in accordance with a boosted pressure, i.e., a load in the engine E.

An air vent pipe 45 is connected to the ceiling wall of the fuel reservoir 35 to communicate with a space above the level of the fuel oil in the fuel reservoir 35. The air vent pipe 45 once extends upwards and is then bent in an inverted U-shape at an upper portion of the engine E and opens into a space 17 within the undercover 14 under the mount case 1. A fuel vapor collector 46 comprising a filter medium is incorporated in a rising path of the air vent pipe 45. The inside of the fuel reservoir 35 is breathed through the air vent pipe 45; and fuel vapor generated within the fuel reservoir at that time is collected by the fuel vapor collector 46, and the thus-liquefied fuel is returned to the fuel reservoir 35.

An electronic control unit 50 is connected to the solenoid valve 39 incorporated in the fuel vapor discharge pipe 38 for controlling the operation of the solenoid valve 39. Connected to the electronic control unit 50 are output ends of a starting motor operation sensor 51 adapted to output a detection signal during operation of an engine-starting motor, a timer 52 adapted to output a detection signal when the lapse of a given time has been measured after starting of the engine E, a temperature sensor 53 adapted to output a detection signal when the engine E or its atmosphere is at a predetermined high temperature, an engine load sensor 54 adapted to output a detection signal when the engine E is in a high load state, as well as an engine rotational speed sensor 55 adapted to output a detection signal when the engine E is in a high-speed rotation state.

To detect a temperature of the engine by the temperature sensor 53, a temperature of a wall of a cylinder head in the engine E or a temperature of water in a water jacket is detected, and to detect a temperature of the atmosphere around the engine E, a temperature of the engine room 16, desirably, a temperature in the vicinity of the primary fuel pump is detected.

Table 1 below shows modes in which the electronic unit 50 controls the solenoid valve 39 to open, based on the detection signals from the various sensors and timer 51 to 55.

TABLE 1

| Control mode | Starting motor operation sensor 51 | Timer 52 | Temperature sensor 53 | Engine load sensor 54 | Engine rotational speed sensor 55 |
|---|---|---|---|---|---|
| 1 | * | | | | |
| 2 | * | * | | | |
| 3 | * | * | * | | |
| 4 | * | * | | * | |
| 5 | * | * | | | * |
| 6 | * | * | * | * | * |

Remark: Mark * indicates the case where a detection signal is output.

The control mode 1 opens the solenoid valve 39 when the electronic control unit 50 has received the detection signal from the starting motor operation sensor 51; the control mode 2 opens the solenoid valve 39 when the electronic control unit 50 has received the detection signals from the starting motor operation sensor 51 and the timer 52 simultaneously; the control mode 3 opens the solenoid valve 39 when the electronic control unit 50 has received the detection signals from the starting motor operation sensor 51, the timer 52 and the temperature sensor 53 simultaneously; the control mode 4 opens the solenoid valve 39 when the electronic control unit 50 has received the detection signals from the starting motor operation sensor 51, the timer 52 and the engine load sensor 54 simultaneously; the control mode 5 opens the solenoid valve 39 when the electronic control unit 50 has received the detection signals from the starting motor operation sensor 51, the timer 52 and the engine rotational speed sensor 55 simultaneously; and the control mode 6 opens the solenoid valve 39 when the electronic control unit 50 has received the detection signals from the starting motor operation sensor 51, the timer 52, the temperature sensor 53, the engine load sensor 54 and the engine rotational speed sensor 55 simultaneously. The control modes 1 to 6 are selected as desired depending on a required specification.

When the starting motor (not shown) is operated to start the engine E, the valve-operating camshaft of the engine E simultaneously drives the primary fuel pump 21 and hence, the pump 21 intends to draw in the fuel thereinto from the fuel tank 26 on the hull H and discharge the fuel into the fuel reservoir through the second fuel pipe 24*b*. At that time, if fuel vapor has been generated in the pump chamber 21*a* due to the high-temperature state of the engine E or the engine room 16, the pumping function of the primary fuel pump 21 is impeded.

In contrast, in the embodiment of the present invention, even when any of the control modes 1 to 6 of the electronic control unit 50 is selected, the electronic control unit 50 receives the detection signal from the starting motor operation sensor 51 to open the solenoid valve 39 in the fuel vapor discharge pipe 38, thereby opening the pump chamber 21*a* in the primary fuel pump 21*d* through the fuel vapor discharge pipe 38 to the fuel reservoir 35. As a result, the fuel vapor in the primary fuel pump 21 is discharged promptly through the fuel vapor discharge pipe 38 into the fuel reservoir 35 with the operation of the primary fuel pump 21 without being obstructed by the discharge valve 32 and the float valve 37, and is then discharged from the fuel reservoir 35 through the vent pipe 45 to the outside.

Particularly, the disposition of the second discharge port 31*b* in the upper portion of the pump chamber 21*a* is effective for promoting the discharge of the fuel vapor in the pump chamber 21*a* to the fuel vapor discharge pipe 38.

The primary fuel pump 21 which has discharged the fuel vapor in the above manner can perform a normal pumping operation immediately. Moreover, a portion of the fuel in the primary fuel pump 21 is supplied through the fuel vapor discharge pipe 38 into the fuel reservoir 35 at that time and hence, the refueling to the fuel reservoir 35 is not delayed, and it is possible to accommodate to the fuel consumption due to the fuel supply to the fuel injection valves 12L and 12R by the secondary fuel pump 40 without a delay, thereby providing an enhancement in hot startability of the engine E.

When the control mode 2 is employed, the electronic control unit 50 continues the opening of the solenoid valve 39 until a given time lapses even after starting of the engine and hence, it is possible to prevent the fuel vapor from remaining in the pump chamber 21*a* in the primary fuel pump 21.

When the control mode 3 is employed, if the engine E or the engine room 16 enters a high-temperature state while a given time is elapsed, the electronic control unit 50 continues the opening of the solenoid valve 39. This also makes it possible to prevent the useless opening of the solenoid valve 39 when the engine E or the engine room 16 is in a low-temperature state in which there is a less possibility of the generation of fuel vapor.

When the control mode 4 is employed, if the engine E enters a high-load state while a given time is elapsed even after starting of the engine, the electronic control unit 50 continues the opening of the solenoid valve 39 and hence, it is possible to carry out the refueling to the fuel reservoir 35 corresponding to the high-load state.

When the control mode 5 is employed, if the engine E enters a high-speed rotation state while a given time is elapsed even after starting of the engine, the electronic control unit 50 continues the opening of the solenoid valve 39 and hence, it is possible to carry out the refueling to the fuel reservoir 35 corresponding to the high-speed rotation state.

When the control mode 6 is employed, if the engine E or the engine room 16 enters a high-temperature state while a given time is elapsed even after starting of the engine, and the engine E is in a high-load and high-speed rotation state, the electronic control unit 50 continues the opening of the solenoid valve 39 and hence, it is possible to carry out the refueling to the fuel reservoir 35 corresponding to the high-load and high-speed rotation state of the engine E, while suppressing the time period of opening of the solenoid valve 39 to a small value to the utmost.

When the electronic control unit 50 returns the solenoid valve 39 to its closed state and closes the fuel vapor discharge pipe 38 after starting of the engine in any of the control modes 1 to 6, the primary fuel pump 21 with its function already normalized continues the refueling to the fuel reservoir 35 through the discharge valve 32, the second fuel pipe 24*b* and the float valve 37, as in a normal state.

Even after stopping of the operation of the engine E, the closed state of the solenoid valve 39 is maintained. Therefore, even when the outboard engine system O has been tilted up, it is possible to prevent the fuel in the pump chamber 21*a* in the primary fuel pump 21 from uselessly flowing through the fuel vapor discharge pipe 38 to the fuel reservoir 35.

If the present invention is applied to a fuel supply system for an engine of an out boat engine system as in the above-described embodiment, even in the engine room 16 which is narrow and difficult to discharge heat in the outboard engine system O, fuel vapor generated in the pump chamber 21*a* in the primary fuel pump 21 can be discharged promptly to the fuel reservoir 35 at starting of the engine, thereby enhancing the hot startability of the engine.

Although the embodiment of the present invention has been described in detail, it will be understood that the present invention is not limited to the above-described embodiment, and various modifications in design may be made without departing from the spirit and scope of the invention defined in the claims. For example, control modes 7 and 8 shown in Table 2 below may be employed as the control mode for controlling the solenoid valve 39 by the electronic control unit 50.

TABLE 2

| Control mode | Starting motor operation sensor 51 | Timer 52 | Temperature sensor 53 | Engine load sensor 54 | Engine rotational speed sensor 55 |
|---|---|---|---|---|---|
| 7 | * | * | * | * | |
| 8 | * | * | * | | * |

What is claimed is:

1. A fuel supply system for an engine in which a discharge port in a pump chamber in a fuel pump driven by the engine to draw up fuel in a fuel tank is connected to an inlet port which is provided in a fuel reservoir having an air vent and which is controlled in opening and closing by a float valve, so that the fuel in said fuel reservoir is supplied to the engine, wherein a second discharge port is provided in said pump chamber, and a second inlet port having no float valve is provided in said fuel reservoir, said second discharge port and said second inlet port being connected to each other through a control valve for controlling the communication between said second discharge port and said second inlet port a supply of fuel from the second discharge port to the second inlet port wherein said control valve selectively allows.

2. A fuel supply system for an engine according to claim 1, wherein said control valve is a solenoid valve which is opened and closed depending on the operational state of the engine.

3. A fuel supply system for an engine according to claim 1 or 2, wherein said control valve is opened during starting of the engine.

4. A fuel supply system for an engine according to claim 3, wherein the opening of said control valve is continued until a given time is lapsed after starting of the engine.

5. A fuel supply system for an engine according to claim 4, wherein when the engine or its atmosphere is in a high-temperature state within said given time, the opening of said control valve is continued.

6. A fuel supply system for an engine according to claim 4, wherein when the engine is under a high load within said given time, the opening of said control valve is continued.

7. A fuel supply system for an engine according to claim 4, wherein when the engine is in a high-speed rotation state within said given time, the opening of said control valve is continued.

8. A fuel supply system for an engine according to claim 1 or 2, wherein said second discharge port is disposed in an upper portion of said pump chamber.

9. A fuel supply system for an engine according to claim 1 or 2, wherein said fuel pump and said fuel reservoir are disposed in an engine room in an outboard engine system, and a fuel pipe leading to an intake port in said fuel pump is connected through a joint to a fuel outlet pipe leading to an outlet of the fuel tank mounted on a hull so that fuel in said fuel reservoir is supplied to fuel injection valves in the engine within said engine room by a secondary fuel pump.

* * * * *

UNITED STATES PATENT AND TRADEMARK OFFICE

CERTIFICATE OF CORRECTION

PATENT NO. : 6,846,212 B2
APPLICATION NO. : 10/143819
DATED : January 25, 2005
INVENTOR(S) : Wada et al.

It is certified that error appears in the above-identified patent and that said Letters Patent is hereby corrected as shown below:

Title Page -

Item [73], Assignee Information

Please add the following Assignee's name and address:

-- Keihin Corporation, Tokyo (JP) --.

Signed and Sealed this

Twenty-eighth Day of August, 2007

JON W. DUDAS
*Director of the United States Patent and Trademark Office*